US009949553B2

(12) United States Patent
Nunez Albalate

(10) Patent No.: US 9,949,553 B2
(45) Date of Patent: Apr. 24, 2018

(54) NOSE PERFECTION

(71) Applicant: Yali Nunez Albalate, Hialeah, FL (US)

(72) Inventor: Yali Nunez Albalate, Hialeah, FL (US)

( * ) Notice: Subject to any disclaimer, the term of this patent is extended or adjusted under 35 U.S.C. 154(b) by 15 days.

(21) Appl. No.: 14/865,110

(22) Filed: Sep. 25, 2015

(65) Prior Publication Data

US 2017/0181527 A1 Jun. 29, 2017

(51) Int. Cl.
*A45D 40/30* (2006.01)

(52) U.S. Cl.
CPC ..... *A45D 40/30* (2013.01)

(58) Field of Classification Search
CPC ..... A45D 40/30
USPC ..... 132/319–320
See application file for complete search history.

(56) References Cited

U.S. PATENT DOCUMENTS

2008/0053476 A1* 3/2008 LaHood ..... A45D 33/38 132/320
2011/0073125 A1* 3/2011 Iosilevich ..... A45D 44/002 132/200
2012/0244316 A1* 9/2012 Dobler ..... A61M 35/00 428/141
2015/0359318 A1* 12/2015 Martin ..... A45D 40/30 132/200
2015/0366763 A1* 12/2015 Barilari ..... A61Q 1/10 132/320
2016/0128919 A1* 5/2016 Sveine ..... A61K 8/35 424/63

* cited by examiner

*Primary Examiner* — Kristen Matter
(74) *Attorney, Agent, or Firm* — Banner & Witcoff, Ltd.

(57) ABSTRACT

A cosmetic nose strip and method of use for adjusting of the appearance of a wearer with cosmetic material is disclosed. The nose strip is provided of a shape a semicircular tab disposed at a horizontal distal edge of the nose strip and extending away for the horizontal distal edge. A left wing of a rectangular shape extends from a left side of the nose strip. A right wing has a rectangular shape that extends from a right side of the nose strip. The right wing is horizontally disposed across from the left wing. An interior of the nose strip has a groove opening configured to receive and hold a cosmetic material therein.

2 Claims, 5 Drawing Sheets

NOSE PERFECTION

This invention is several adhesive cosmetic mold strips for application to the nose of a wearer.

A purpose of the mold strip is to provide a specific shape and appearance to the nose of the wearer that corrects any imperfections.

SUMMARY

The cosmetic nose strip provides precision on the lines that should be contoured on the nose to perfect or create a certain desired appearance. The makeup contour lines on the strip will allow the user to change the appearance of the shape of the nose. This nose strip creates precision, showing which lines on the nose need to be contoured to change the appearance of a flat nose, a triangular nose, a crooked nose, and a narrow nose. Each cosmetic nose strip will be matched with the corresponding nose shape.

BRIEF DESCRIPTION OF THE DRAWINGS

Aspects of the present disclosure may be acquired by referring to the following description in consideration of the accompanying drawings, in which like reference numbers indicate like features, and wherein.

DETAILED DESCRIPTION

In the following description of the various embodiments, reference is made to the accompanying drawings, which form a part hereof, and in which is shown by way of illustration various embodiments in which the disclosure may be practiced.

Figure 1:
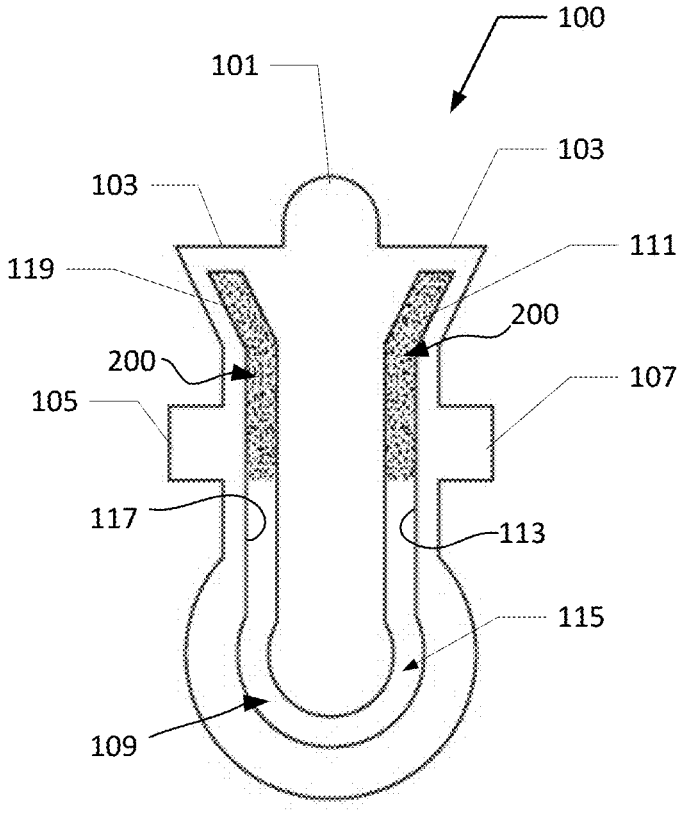
FIG. 1 illustrates an embodiment of a cosmetic mold strip for application to the nose.

Referring to FIG. 1, the strip 100 enables contour lines on the skin of certain parts of the nose to accomplish a desired nose shape and corrects the appearance of the nose imperfections. When attached to the nose, the part where the makeup is located, will leave an impression mark where the nose needs to be contoured. The mark of the contouring can later on be blended using a recommended makeup brush for a more accurate result. The strip to be used will depend on which type of nose the person has. The mark with the impression material, which can adopt the form of a curved line, or other geometric shape, will be moisturized with a cosmetic material. Structurally the strip 100 is formed by the following parts:

1) A clear holding member layer with a cosmetic material 200 deposited onto the holding member layer.

2) Attached to the strip there will be an impression of a shape that will be covered with a cosmetic material. In some strips there will be darker shades and lighter shades. There can be one or more shades in one mold strip.

Referring to FIG. 1, the shape of the strip 100 is explained. A semicircular tab 101 is disposed at a distal edge 103 of the nose strip 100. A left wing 105 of rectangular shape extends from a left side of the nose strip 100. A right wing 107 of a rectangular shape extends from a right side of the nose strip 100. As can be seen in FIG. 1, the right wing 107 is horizontally disposed across from the left wing 105. Further, as can be seen in FIG. 1, an interior of the nose strip 100 has a continuous groove opening 109 configured to receive and hold a cosmetic material therein. The groove opening 109 is defined by a right side inclined portion 111 disposed at an acute angle to a right side rectilinear portion 113 and connected thereto; the right side rectilinear portion 113 extending downwardly to a U shape portion 115 and connected to an upwardly extending a left side rectilinear portion 117 that is connected to left side inclined portion 119, the left side inclined portion 119 being disposed at an acute angle to the left side rectilinear portion 117. Here is a list of the strips for the different types of noses.

Figure 4:
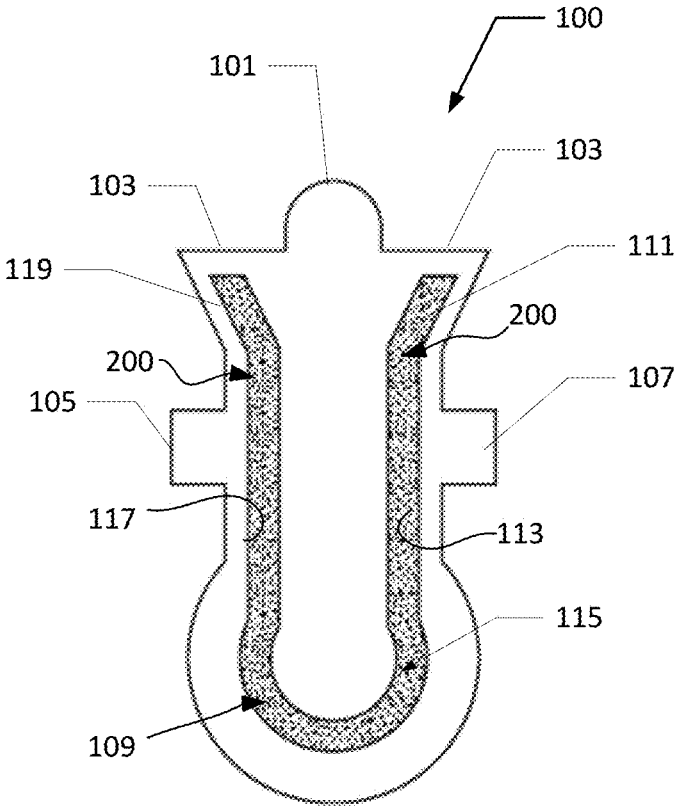
FIG. 4 illustrates an alternative embodiment of a cosmetic mold strip used for application to the nose.

Referring to FIG. 4, Flat Nose: For a flat nose, the strip 100 will be particularly conformed by: a strip with a close "U" form which will have two parallel lines that will stress the person's right and left sides of the nose's bridge with an ink, foundation or cosmetic material in a darker shade than the person's skin color. Those two parallel lines will give accurate definition and accentuation of the left and right sides of the nose's bridge.

Optional on the strip: The frontal part of the nose or dorsum will be covered with a shade lighter than the person's skin color to add luminosity and appearance of a more prominent bridge. Advantageously each side of the strip is attached to those parallel lines made by this product.

After the application and removal of the strip 100 the marks made by the cosmetic product should be blended with a makeup brush or pad with a sponge for a better result, (this applies to every strip).

Figure 5:
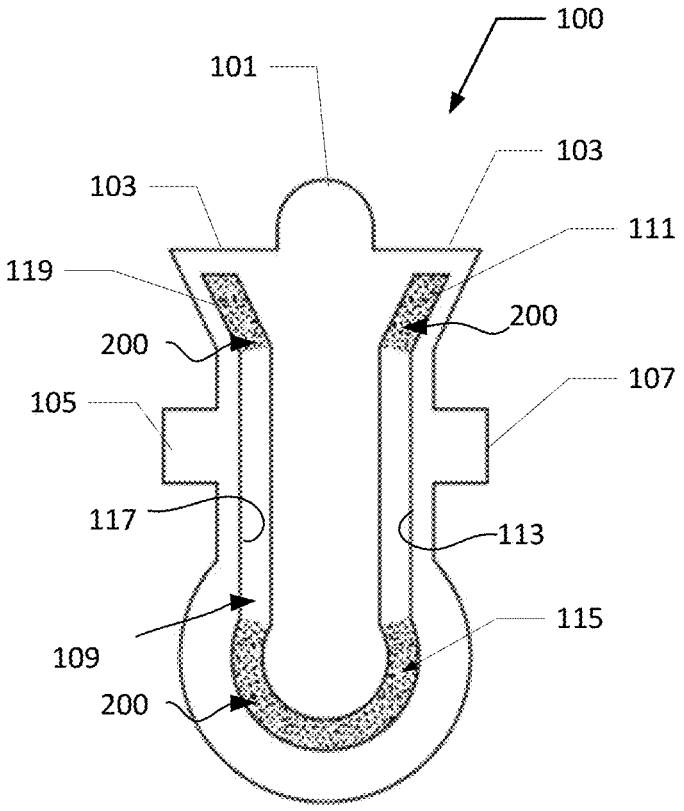
FIG. 5 illustrates an alternative embodiment of a cosmetic mold strip used for application to the nose.

Referring to FIG. 5, Triangular nose: For a triangular nose the cosmetic materials used on the strip 100 will have two different shades for two different parts of the nose which will contour as follows: 1) The lighter shade will be used on the inside corner of the eyes near the bridge of the nose to highlight and create the illusion of more space.

2) The darker shade will be used on the left, right, and bottom of the tip (with a semi-circular shape) of the nose.

The objective of this strip is to create the illusion of more space on the sides, to make it look wider than what it is and make the tip narrower.

After the application and removal of the strip the marks made by the cosmetic product should be blended with a makeup brush or pad with a sponge for a better result, (this applies to every strip).

Figure 2:
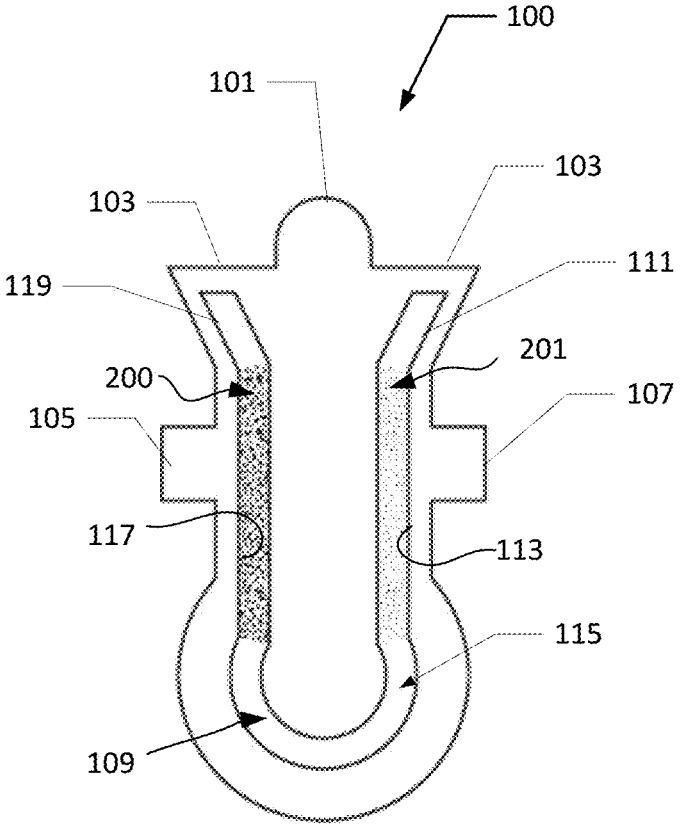
FIG. 2 illustrates an alternative embodiment of a cosmetic mold strip used for application to the nose.

Referring to FIG. 2, Crooked Nose: For a crooked nose the cosmetic materials used will have two shades 200, 201 for two sides of the nose:

1) The crooked side; and

2) The tilted side.

Crooked Side

The crooked side of the strip will use the dark shade applied to where it is crooked (this shade is represented with the dark shade of a cosmetic material in a linear shape).

Tilted Side

On the side where there is a tilt of the nose, a lighter shade will be used in order to highlight that side of the nose.

The objective of this strip is to create an appearance of a more even and straight nose.

After the application and removal of the strip the marks made by the cosmetic product should be blended with a makeup brush or pad with a sponge for a better result (this applies to every strip).

Figure 3:
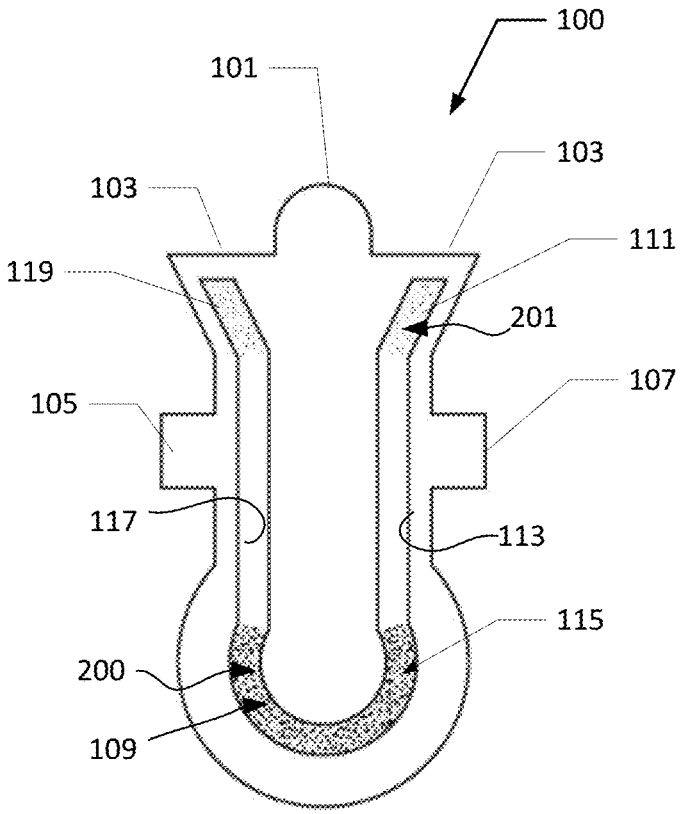
FIG. 3 illustrates an alternative embodiment of a cosmetic mold strip used for application to the nose.

Referring to FIG. 3, Narrow Nose: For a narrow nose the strip 100 will provide wide and thick lines with a lighter shade 201 (of cosmetic material) than the person's skin color to create a highlight effect which then needs to be blended. The lighter shade lines will start with a small curvature on the inside corner of the eyes and will extend only to about half of the nose.

After the application and removal of the strip the marks made by the cosmetic product should be blended with a makeup brush for a better result. (This applies to every strip)

The end result is a well defined contour or outline of the parts of the nose that are to be corrected to change the appearance of it (the nose).

The intended use of the strip 100 is to provide the contouring or outline of different noses, since different noses may need a variation of corrections in order to obtain a different look or appearance.

The cosmetic strips will include the following elements in physical structure:

Clear additive strip material and an adhesive material where the foundation or cosmetic material adheres.

The invention claimed is:

1. A cosmetic nose strip for adjusting an appearance of a nose of a wearer with a cosmetic material, comprising:

a semicircular tab disposed at a horizontal distal edge of the nose strip and extending away from the horizontal distal edge;

a left wing having a rectangular shape extending from a left side of the nose strip;

a right wing having a rectangular shape extending from a right side of the nose strip, the right wing being horizontally disposed across from the left wing;

an interior of the nose strip having a groove opening configured to receive and hold the cosmetic material therein, the groove opening being defined by a right inclined portion disposed at an acute angle to a right rectilinear portion and connected thereto; the right rectilinear portion extending downwardly to a generally U-shape portion and connected to an upwardly extending left rectilinear portion that is connected to a left inclined portion, the left inclined portion being disposed at an acute angle to the left rectilinear portion; and an adhesive material for attaching the nose strip to the nose of the wearer during use.

2. The cosmetic nose strip according to the claim 1, wherein the groove opening is continuous between the right inclined portion, the right rectilinear portion, the U-shape portion, the left rectilinear portion, and the left inclined portion.

* * * * *